US006021620A

United States Patent [19]

Vermilion et al.

[11] Patent Number: 6,021,620

[45] Date of Patent: Feb. 8, 2000

[54] ASPHALT BASED PENETRATION POCKET

[75] Inventors: Donn R. Vermilion, Newark, Ohio; David C. Trumbore, LaGrange; Richard T. Janicki, Oak Lawn, both of Ill.

[73] Assignee: Owens Corning Fiberglas Technology, Inc., Summit, Ill.

[21] Appl. No.: 09/220,306

[22] Filed: Dec. 23, 1998

Related U.S. Application Data

[62] Division of application No. 08/922,666, Sep. 3, 1997, Pat. No. 5,899,034.

[51] Int. Cl.[7] ..... E04D 13/14; E04B 7/00; E04G 21/00

[52] U.S. Cl. ..... 52/741.4; 52/219; 52/511; 52/199; 52/742.13; 52/745.21

[58] Field of Search ..... 52/219, 741.4, 52/742.1, 742.13, 745.21, 42, 199, 511; 285/42

[56] References Cited

U.S. PATENT DOCUMENTS

| | | | |
|---|---|---|---|
| 5,414,964 | 5/1995 | Bodycomb | 52/219 X |
| 5,535,559 | 7/1996 | Nielsen et al. | 52/219 X |
| 5,768,838 | 6/1998 | Georgeau | 52/741.4 X |
| 5,829,214 | 11/1998 | Hart | 52/741.4 X |

*Primary Examiner*—Carl D. Friedman
*Assistant Examiner*—Brian E. Glessner
*Attorney, Agent, or Firm*—Inger H. Eckert; James J. Dottavio

[57] ABSTRACT

A penetration pocket, useful to seal roof openings at protruding pipes or the like, is made of a material compatible with roofing asphalt. The penetration pocket material is asphalt-based with polymeric materials added to impart strength and toughness. Fibrous material may also be added for increased strength. The roofing asphalt, when applied around the penetration pocket, fuses with penetration pocket walls and base, and upon cooling, the penetration pocket and the roofing asphalt are welded together to effect a secure, water-proof joint.

3 Claims, 2 Drawing Sheets

ASPHALT BASED PENETRATION POCKET

CROSS REFERENCE TO RELATED APPLICATION(S)

This is a division of U.S. patent application Ser. No. 08/922,666, filed Sep. 3, 1997, now U.S. Pat. No. 5,899,034.

TECHNICAL FIELD AND INDUSTRIAL APPLICABILITY OF THE INVENTION

This invention relates in general to a device to seal the joint between a building roof and an element protruding therethrough. More particularly, this invention relates to a device, commonly referred to as a penetration pocket, which is placed around a pipe, such as a vent pipe, that extends up to and through the roof of a building. When the roof is covered with hot asphalt, the penetration pocket serves to seal the joint between the roof and the pipe to prevent water, or other materials, from seeping into the building.

BACKGROUND OF THE INVENTION

With the widespread development and use of flat or low slope roofs, as in office buildings or similar structures, the need for long-lasting sealing systems to seal the openings in such roofs through which pipes pass has led to the development of many types of sealing devices. Commonly referred to as "penetration pockets," these devices are frequently constructed of metal, and typically comprise a flat base with an opening in the middle for the protruding pipe, and an upstanding wall around the periphery of the hole adjacent to the pipe. Such devices are placed around pipes extending through a low slope or flat roof of a building prior to the roof being covered with roofing asphalt. After placement around the protruding pipe, the gap between the pipe and the upstanding wall of the pocket is typically sealed by pouring a sealant such as asphalt or a waterproof adhesive into the gap, and the interface between the base and the roof is sealed by the roofing asphalt applied onto the roof.

Unfortunately, these systems have several major drawbacks. For instance, such penetration pockets are frequently comprised of a plurality of metal parts or sections which have to be assembled on site, and which require that the seams between adjoining sections be sealed, which often lengthens the roof sealing process. Moreover, the greater the number of sections, the more seams to be sealed and the greater the chances of seepage after the penetration pocket's installation. Furthermore, even though the gap between the upstanding wall section of the penetration pocket and the pipe is typically filled with a sealant, and the interface between the base of the penetration pocket and the roof is sealed when the building roof is covered with asphalt, over time, the penetration pockets often separate from the sealant and roofing asphalt creating gaps that destroy the seal.

Consequently, a need exists for a prefabricated penetration pocket which is easily installed on site, and which forms a long-lasting seal between the penetration pocket and the sealant and roofing asphalt materials. These needs are met by the asphalt-based penetration pockets of the invention described herein.

SUMMARY OF THE INVENTION

The present invention helps solve the above-mentioned problems, and overcomes the drawbacks of conventional penetration pockets, by providing a penetration pocket which is easily and simply applied around a pipe protruding through the roof of a building, and which is capable of forming a superior seal between the penetration pocket and the roofing material. Specifically, the invention provides a penetration pocket comprised of an asphalt-based composition that will diffuse into the hot roofing asphalt as it is applied onto the roof around the installed penetration pocket to form, upon cooling, a fused weld-like seam between the penetration pocket and the roofing asphalt that provides a long-lasting weather-tight seal.

The asphalt-based composition of the penetration pocket is predominately asphalt, similar to that used on the roof, with polymeric materials added thereto to impart increased strength and toughness to the composition. The polymeric materials are mixed with the asphalt to form a moldable composition which is then formed into the penetration pocket. Additionally, fibrous reinforcing materials may be added to the asphalt-based composition to increase the strength and toughness of the resulting penetration pockets.

The penetration pocket of this invention may be a single piece unit to be installed by placing it over a protruding pipe, or it may be split in cross-section such that it may be placed around a protruding pipe without being placed over the pipe. The edges of the penetration pocket at the split may be advantageously designed to overlap, or even dovetail, to increase the seal along the edges as the asphalt is applied.

DETAILED DESCRIPTION AND PREFERRED EMBODIMENTS OF THE INVENTION

Figure 1:
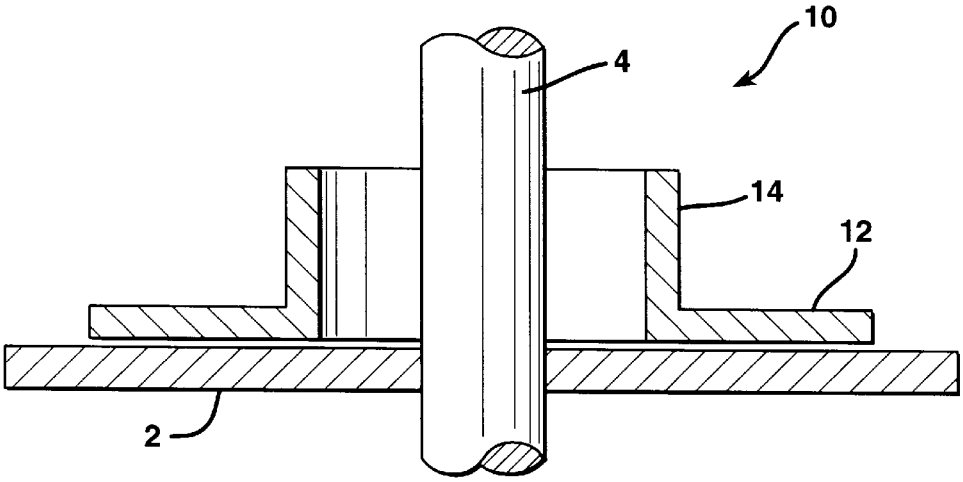
FIG. 1 is a side view, partially in section, of the invention installed around a pipe extending through a roof.
Figure 2:
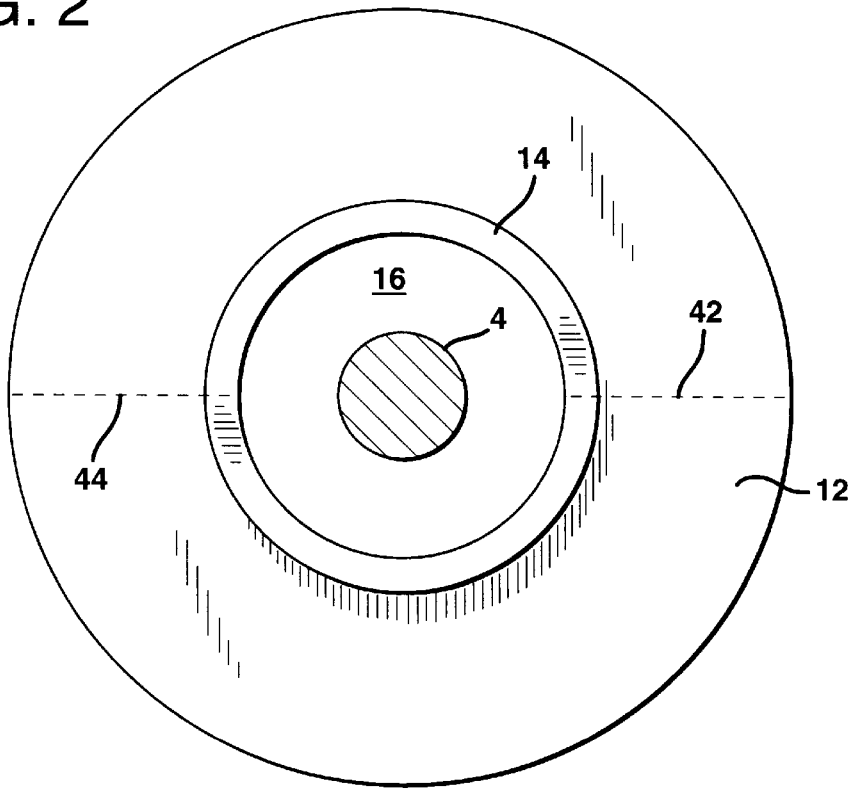
FIG. 2 is a top view of FIG. 1.

The penetration pocket of the invention is primarily intended for use on flat or low sloped roofs that are covered, such as by "mopping" with molten asphalt. As illustrated in FIGS. 1 and 2, penetration pocket 10 is shown situated around a pipe 4, such as a vent pipe, protruding through roof 2 of a building. Roof 2 is flat or of low slope as is commonly found in large buildings. Generally, the roof will be metal or poured concrete covered with a build-up of roofing paper, tar or felt, for basic water-proofing, and a layer or layers of insulation materials. Following the application of these materials, and before a layer of hot, viscous asphalt 6 is to be applied over the entire roof area, the protruding pipes 4, and the like, must be sealed where they extend through the roof because, over time, the roofing asphalt tends to shrink and pull away from such pipes. To solve this problem, penetration pocket 10 is placed around pipe 4, and the gap therebetween sealed, prior to the application of asphalt to the roof.

The penetration pocket of the present invention 10 comprises a base or flange 12 having an opening 16 therein to accommodate a pipe, or the like, which extends through a building roof, and an upstanding wall 14 attached to the base which circumscribes the opening. The base and opening of penetration pocket 10 are both shown to be circular, but it is to be understood that either may be square, rectangular, or any other useful geometry, as desired. Additionally, although the opening is illustrated as being in the center of the base, this in not a requirement.

The size of the base, and the opening therein, can vary widely and are generally dictated by the size of the pipe and the opening in the roof through which the pipe passes. Preferably, however, the base 12 and walls 14 are from about 0.060 inches to about 0.250 inches thick, and wall 14 rises from about 4 inches to about 12 inches above the base.

The penetration pocket base and upstanding wall may be formed in numerous ways consistent with the spirit of the invention. For example, the base and wall portions may be formed separately, and joined together via an adhesive, sealant or hot weld, prior to or during installation, or during the application of the roofing asphalt. However, it is generally preferred that the base and wall portions be formed together as an integral unit.

Further, the integral base and wall unit can be formed as a single piece to be installed by placing it over a protruding pipe, or to be slit or opened at the job-site to be installed around a pipe without passing over it. To this end, the penetration pocket may be scored during manufacture to facilitate its opening at the job-site for placement around a pipe. Such an embodiment is shown in FIG. 2, wherein the penetration pocket is provided with scored seams 42 and 44 in both the base and wall during manufacture, which allow the penetration pocket to be partially opened to be slipped around pipe 4 by tearing one of the seams 42 and 44; or it may be fully torn in half to be placed around pipe 4. In either event, the torn seams may be rejoined after installation by an adhesive, a clamp or hot weld, and sealed by the application of hot, mopped asphalt or other sealant.

Figure 3:
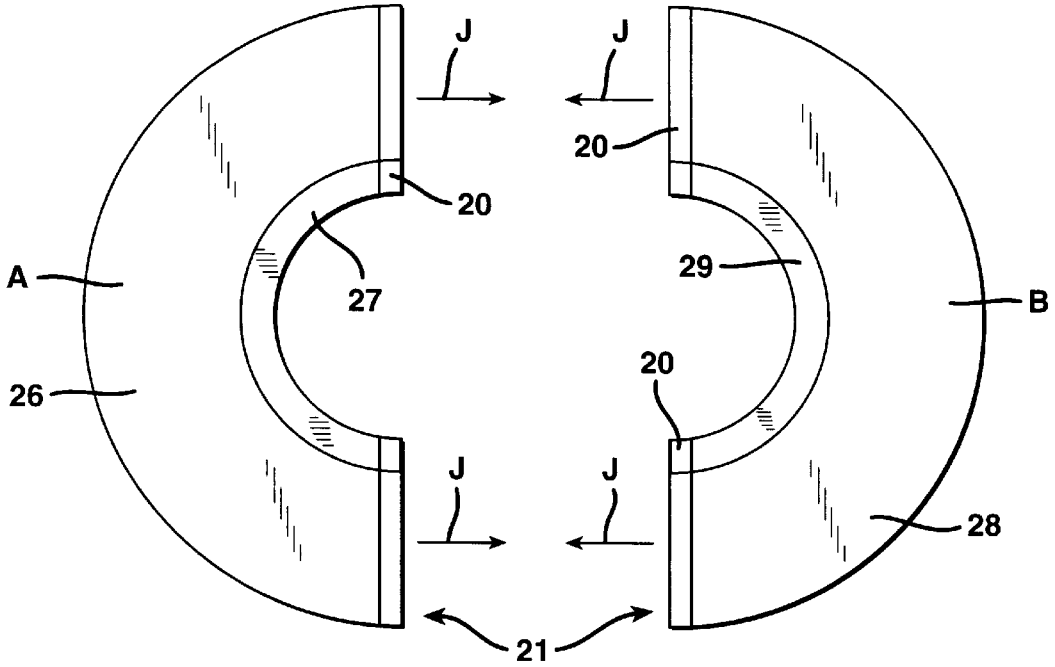
FIG. 3 is a view of an alternative embodiment of the invention, prior to use.
Figure 4:
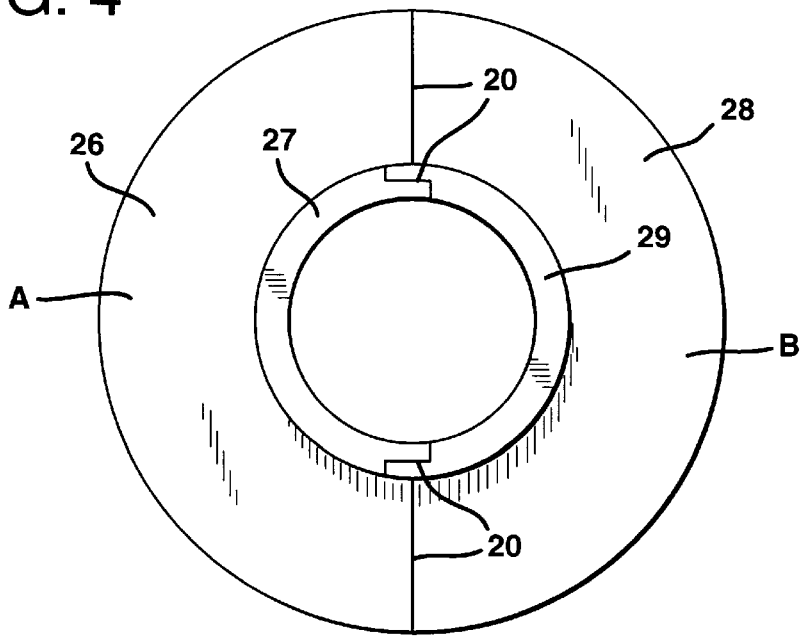
FIG. 4 is a cross-section of the embodiment of FIG. 3 in final, installed form.

Alternately, the penetration pocket may be formed with a vertical slit therethrough to allow it to be spread open, or in two (or more) sections, to facilitate placement around a protruding pipe, with edges to be joined after placement. For example, as shown in FIGS. 3 and 4, the penetration pocket may be manufactured in two sections or halves A and B to be assembled, on site, into a single unit when joined at their respective edges 20 as indicated by arrows J. Each section includes a joining edge 20 in both the base and wall portions which abuts, overlaps, mates or interlocks with the edge of the corresponding portion of the adjacent section. For example, base 26, and upstanding wall 27 of Section A may have an edge 20 profile which is partly cut away, and the base 28 and wall 29 of Section B may have a reciprocally cut away mating edge such that the edges overlap or mate as seen in FIG. 4 when the penetration pocket is assembled around a pipe. The edges may be held together with an adhesive or clamp, hot welded together with a torch, or formed with an interlocking design that securely holds them together after they are joined. The seams created by the mating edges may then be sealed when the roof and penetration pocket are covered with molten asphalt.

The penetration pocket is preferably composed of asphalt with polymeric materials added to impart strength and toughness. Additionally, high melting temperature fibers, such as glass, polyester or carbon fibers, may also be included in the composition to impart increased strength and toughness. When hot molten asphalt is applied to the roof, the walls and base of the penetration pocket partially melt and diffuse into the roofing asphalt such that the penetration pocket and roofing asphalt become fused together as the asphalt cools. The gap between the penetration pocket and the protruding pipe may be filled with a sealant such as ASTM D 312 roofing asphalt, or a cold applied sealant such as thermosetting polymer modified asphalts.

The term "asphalt" is meant to include asphalt bottoms from petroleum refineries, as well as naturally occurring bituminous materials such as asphalts, gilsonite, tars, and pitches, or these same materials that have been air-blown or otherwise chemically processed or treated. For example, the asphalt can be air blown with catalysts such as ferric chloride and the like. The asphalt can be a conventional roofing flux asphalt or a paving-grade asphalt, as well as other types of asphalts, including specialty asphalts such as water-proofing asphalts, battery compounds, and sealers. Blends of different kinds of asphalt can also be used.

The asphalt used in the composition preferably has a ring and ball softening point of from about 95° C. to about 165° C., more preferably from about 120° C. to about 165° C., and more preferably from about 145° C. to about 150° C., measured according to ASTM D36, to ensure that the penetration pocket can withstand temperatures encountered in shipping and storage and yet be softened or partially melted when contacted with molten roofing asphalt. Such preferred asphalts include air-blown roofing flux asphalt and air-blown paving-grade asphalt in the range of from AC-2 to AC-50, more preferably from AC-10 to AC-20.

In general, the polymeric materials of the moldable asphalt composition can be any polymer or mixture of polymers that is sufficiently miscible and compatible with the asphalt to form a substantially homogeneous moldable mixture, and which provides the resulting penetration pocket with sufficient strength, toughness and thermal stability to be substantially form stable under the conditions of its use. Preferably, the polymeric materials are selected and added in amounts sufficient to provide the resulting penetration pocket with an unnotched izod impact strength of at least about 13 joules to ensure that the penetration pocket can withstand rough handling. Further, the asphalt and polymers are preferably selected such that the resulting composition will only be softened or partially melted when contacted by roofing asphalt at temperatures of from about 200° C. to about 235° C.

Useful polymeric materials include thermoplastic polymers such as styrene-acrylonitrile, polybutylene terephthalate, polyurethane, thermoplastic polyolefins such as high density polyethylene, low density polyethylene, polypropylene, ethylene-propylene copolymers and butylene copolymers, polyolefins modified with maleic anhydride, copolymers of olefins with acrylates and methacrylates, ethylene-vinyl acetate copolymers and natural or synthetic rubbers. Certain types of polymers help provide the penetration pocket with high toughness and impact resistance, while others help impart strength and thermal stability. For example, useful polymers that improve the impact-resistance and flexibility of the penetration pocket include epoxy-functionalized copolymers such as Elvaloy® AM, a terpolymer of ethylene, butyl acrylate and glycidyl methacrylate, available from E.I. duPont de Nemours & Co. (Wilmington, Del.), vinyl acetate copolymers, copolymers of olefins and acrylates or methacrylates, such as ethylenemethylacrylate, as well as natural or synthetic rubbers, such as styrene-butadiene-styrene (SBS), styrene-butadiene rubber (SBR), styrene-ethylene-butylene-styrene (SEBS), or terpolymers made from ethylene-propylene diene monomer (EPDM). Further, exemplary polymers that may be used to impart strength and thermal stability to the asphalt-based composition include polyolefin polymers selected from ethylene, propylene, ethylene-propylene copolymers, and butylene copolymers, optionally modified with maleic anhydride, as well as copolymers of such olefins with acrylates and methacrylates, such as butyl, propyl, ethyl, or methyl acrylate or methacrylate copolymerized with ethylene, propylene, or butylene.

Polymers such as ethylene-vinyl acetate by themselves do not always provide sufficient strength and high temperature stability to the moldable asphalt composition for the resulting penetration pocket to withstand the high temperatures encountered during shipping and storage without deformation. On the other hand, a polymer such as polypropylene by itself is not always sufficient to provide the moldable asphalt composition with sufficient toughness and impact resistance to withstand rough handling. However, when an elastomeric polymer such as ethylene-vinyl acetate is added to the asphalt in combination with a thermoplastic polymer having high temperature stability such as styrene-acrylonitrile, polybutylene terephthalate, polyurethane or thermoplastic polyolefin, the resulting composition provides penetration pockets exhibiting enhanced thermal stability, strength and toughness.

A preferred asphalt-based composition for manufacture of the penetration pocket comprises a roofing asphalt such as ASTM D312, Type 4, available from Trumbull Asphalt, strengthened by adding a polymer such as polypropylene, preferably having a melting point of about 163° C. and a crystallinity of about 40%, and toughened by adding an elastomeric polymer such as styrene-butadiene-styrene, styrene-butadiene rubber, styrene-ethylene-butylene-styrene, ethylene-propylene-diene monomer, ethylenevinylacetate or ethylenemethylacrylate. Suitable ethylene vinyl acetate polymers preferably have a vinyl acetate content of from about 9% to about 40% by weight, so that they are sufficiently soluble in the asphalt. Additionally, ethylene-vinyl acetate copolymers with a softening point of at least about 150° C. can improve the thermal stability of the penetration pocket while still allowing diffusion during application of the roofing asphalt. Preferred ethylene-vinyl acetate copolymers are the "Elvax" series from duPont, such as Elvax 360 through 750, with Elvax 360 (75% ethylene, 25% vinyl acetate) generally being most preferred. Ethylene-vinyl acetate copolymers are also available from USI Chemicals under the trade names "Ultrathene" and "Vynathene".

The moldable asphalt composition preferably comprises, by weight, from about 20% to about 70% asphalt, from about 10% to about 50% of a strengthening polymer such a polypropylene, more preferably from about 20% to about 40%, and from about 5% to about 30% of the elastomeric polymer. Further, if additional strength is needed, fibrous materials such as glass fibers, polyester fibers, carbon fibers, or other high melting point fiber may be added to the composition in amounts of from about 2% to about 25% by weight. Additionally, fillers commonly used in asphalt compositions, such as limestone, silica, wollastonite, talc, and the like, may also be added to the moldable asphalt composition if desired. Preferably, such fillers comprise no more than about 65% by weight of the moldable composition.

The penetration pockets of the invention may be manufactured by compression or injection molding techniques. Additionally, if there are no fibers present in the composition, vacuum forming techniques may also be used. However, an injection molding process is particularly preferred. As known to persons skilled in the art, such a process usually involves the use of a screw and heated barrel assembly to heat-soften the composition to be molded. The heat-softened composition is then injected into a closed mold, usually by the action of the screw moving forward. The composition cools and solidifies, taking the shape of the mold cavity.

Thus, a penetration pocket has been described which provides superior water sealing because the materials of the penetration pocket diffuse into the hot asphalt roofing material as it is applied to the roof to form weld-type seams or interfaces therebetween. Also, significant cost reductions are realized because the penetration pockets are pre-formed and little or no assembly is required on site.

What is claimed is:

1. The process of sealing a joint between a low slope roof and an element protruding therethrough, said process comprising:

a. placing on said roof and around said protruding element a penetration pocket composed of an asphalt-containing material comprising a base having an opening therein to accommodate said protruding element, and an upstanding wall around said opening;

b. placing a sealant within the opening between the protruding element and said wall; and c. coating said roof and said penetration pocket with hot, molten, roofing asphalt to form a seal between said roofing asphalt and said penetration pocket.

2. The process of claim 1, wherein said roofing asphalt is applied at a temperature of from about 200° C. to about 235° C.

3. The process of claim 2, wherein said penetration pocket partially melts and fuses with said roofing asphalt upon cooling.

* * * * *